US006388215B1

(12) United States Patent
Sepelak et al.

(10) Patent No.: US 6,388,215 B1
(45) Date of Patent: May 14, 2002

(54) SWITCH CONTACT CONFIGURATION

(75) Inventors: James G. Sepelak, Bellefontaine; Michael J. Holland, Hilliard, both of OH (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

(21) Appl. No.: 09/606,992

(22) Filed: Jun. 29, 2000

(51) Int. Cl.[7] ..... H01H 1/42
(52) U.S. Cl. ..... 200/254; 200/257; 200/162
(58) Field of Search ..... 200/271–275, 200/237–261, 254, 255; 218/146, 16, 17, 18, 20

(56) References Cited

U.S. PATENT DOCUMENTS

| | | | | | |
|---|---|---|---|---|---|
| 523,724 | A | * | 7/1894 | Linton | 200/254 |
| 1,935,516 | A | * | 11/1933 | Musgrave | 200/155.55 |
| 1,935,598 | A | * | 11/1933 | Koppitz | 200/171 |
| 3,567,889 | A | * | 3/1971 | Latter | 200/162 |
| 3,624,333 | A | * | 11/1971 | Schurr | 200/166 SD |
| 5,072,081 | A | * | 12/1991 | Sepelak et al. | 200/144 R |
| 5,475,191 | A | * | 12/1995 | Doudon | 200/257 |
| 5,969,308 | A | * | 10/1999 | Pever | 200/15 |

* cited by examiner

*Primary Examiner*—P. Austin Bradley
*Assistant Examiner*—Nhung Nguyen

(57) ABSTRACT

A switch which permits the use of high contact spring force without the correspondingly high mechanism actuator force typically needed with a switch which utilizes a high contact spring force.

3 Claims, 3 Drawing Sheets

SWITCH CONTACT CONFIGURATION

FIELD OF THE INVENTION

The present invention relates to electric switches, and more particularly to high amperage switches.

BACKGROUND OF THE INVENTION

Switches and circuit breakers which interrupt electric current are extensively employed in residential, industrial and commercial applications. Switches and circuit breakers suffer from the drawback that the operating speed of the switch is dependent upon their mechanism springs and the condition of their contacts. When the switch is operated using too low a speed, an arc will be formed between the contacts that can ultimately or very suddenly destroy the switch as the energy released by the arc has a greater burning effect the longer the arc is maintained. Arcing causes deterioration of the contacts of the breaker and produces arc gases. Arcing also necessitates switches with greater separation between the contacts in the open position to ensure that the arc does not persist with the contacts in the fully open position. During generation of an arc in a switch, metal particles are scattered from the electrical contact elements, which degrades the electrical contact elements by pitting the surface of the contact elements thereby decreasing the surface area available to make electrical contact.

The prior art has used various methods to extinguish the arc generated under fault conditions. These methods include increasing the length of the arc, decreasing the temperature of the arc, and breaking up the arc in a plurality of other arcs. Prior art devices have also been developed to limit the occurrence of arcing or extinguish it rather than to accommodate the effect of arcing on the switch without degradation of the switch reliability or of its design lifetime. In efforts to limit the occurrence of arcing in some types of switchgear, the switch blades/contacts in some prior art designs are surrounded by an enclosed atmosphere of gas or in a vacuum. In other designs, a resistor in parallel to the switch contacts, is used to limit arcing. In a current limiting circuit breaker, the current limiting contacts are in series with the main contacts of a breaker where a resistor, having a positive temperature coefficient of resistance has its resistance increased due to short circuit current flow thereby limiting the short circuit current buildup. In yet other prior art devices, mechanical means are used to break the arc including inserting an electrical insulating screen or wedge between the contacts during opening of the switch contacts. Notwithstanding the advent of such prior art devices, circuit breakers and switches still have a significant amount of arcing accompanying their operation.

With high amperage switches (above approximately 400 amps), contact pressure is extremely important. With low contact pressure, the possibility of mechanical failure from an overheating condition in the switch increases dramatically as the amperage of the switch increases. Similarly, low contact pressure can cause major problems including mechanical failure of the switch when high fault currents are passed through the switch.

It would therefore be an advantage over the prior art to obtain higher contact pressure between the electrical contacts of the switch without increasing the switch mechanism actuation force which is required to turn the switch on or close the circuit. Increasing the actuation force is undesirable since it makes the switch difficult to operate or turn on, especially when the switch is used in busway or panelboard locations which have limited space and have smaller operating handles to operate the switch.

It would therefore be a further advantage over the prior art to provide a switch with electrical contacts which prevent undesirable contact degradation as the switch is cycled and which can cause the switch not to close completely leading to overheating.

Most prior art high amperage switches have flat contact blades that rely on heavy contact springs for providing the necessary contact pressure between the switch contacts. As the contact pressure increases, it becomes more difficult to turn on the switch, particularly with high amperage blade type switches which have large contact blades. Thus, most high amperage blade type switches are difficult to turn on or off.

Most high amperage blade type switches also are subject to other problems as it is tuned on and off under load. Due to large overload currents, the switch contacts quickly degrade due to pitting from arcing until the friction from the pitted switch contacts is greater than that which the switch mechanism can overcome. Once the friction force is greater than that which the switch mechanism can provide, the switch contacts will not fully engage one another causing the switch to rapidly overheat under electric loading.

As a result of the degradation and the elimination of portions of the electrical contact surface of the switch contact blades from arcing, prior art switches need progressively higher actuation springs in order to obtain /maintain the needed increased pressure between the progressively degraded electrical contacts of the switch as the switch cycled.

It would therefore be an advantage over the prior art to have a switch which permits the use of a high contact spring force without the correspondingly high mechanism actuator force typically needed with a switch which utilizes a high contact spring force.

SUMMARY OF THE INVENTION

These and other objects of the invention are achieved by providing an electric switch comprising a housing, a line side strap, a load side strap, a switch blade for establishing electrical continuity by making electrical contact to the line slide strap and to the load side strap and for breaking electrical contact to the line side strap and to the load side strap, the blade having a raised contact surface positioned toward a proximate end, a blade spring for contact with and biasing the switch blade toward the line side strap and the load side strap, and where the switch blade further has a longitudinal edge and a far edge, and a notch is formed into the switch blade from the longitudinal edge toward the far edge, the notch being disposed toward the proximate end of the switch blade, and the raised electrical contact surface of the switch blade is positioned between the proximate end and the notch.

DESCRIPTION OF THE INVENTION

Figure 1:
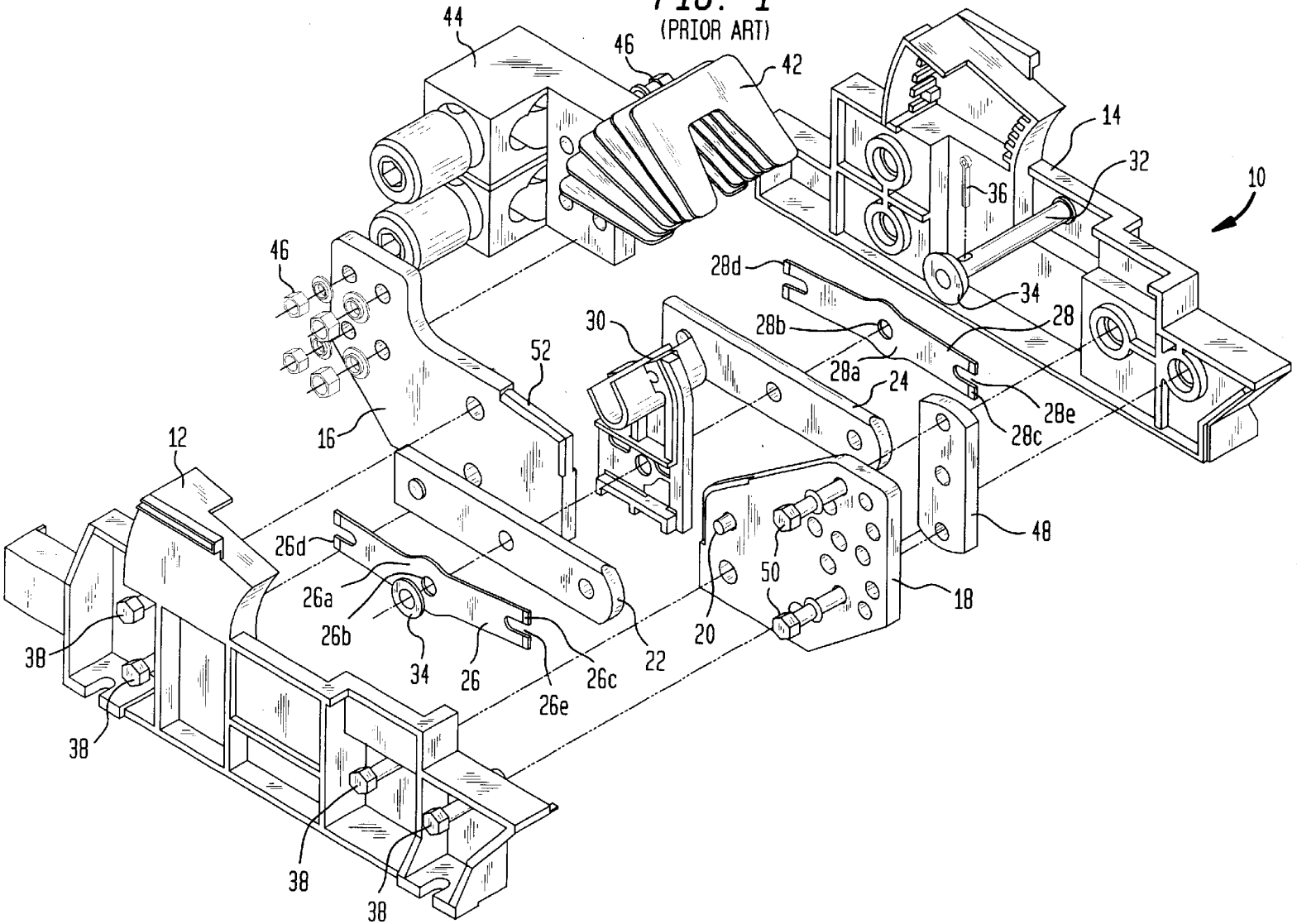
FIG. 1 (PRIOR ART)
FIG. 1 is an exploded view of an electrical contact switch.
Figure 2:
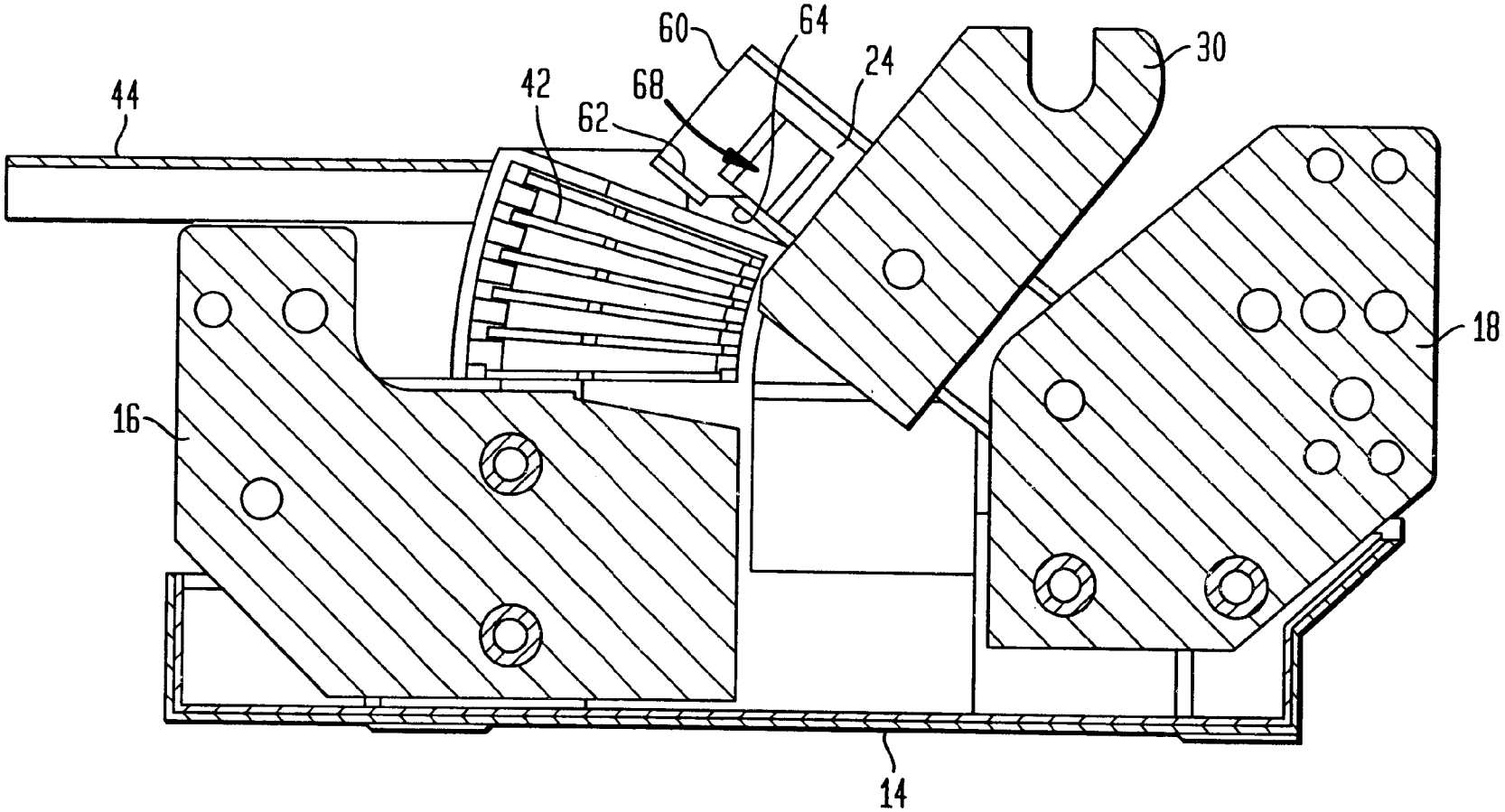
FIG. 2 is a cutaway side view simplified sketch of the switch shown in FIG. 1 with the left housing, left blade and left blade spring portions removed to show the electrical contact blade in accordance with the present invention.

Referring to FIG. 1 which is a figure in U.S. Pat. No. 5,475,191 and which patent is hereby incorporated by reference, an electrical switch 10 is shown and which is suitable for application up to 600 volts alternating current electrical power distribution systems, which are commonly used throughout the world. Switch 10 is suitable for 400 Amp to 800 Amp rating applications. While only a single phase of electric power can be serviced by switch 10 as can be appreciated by those skilled in the art, a plurality of switches 10 can be placed in a single enclosure for multi-phase applications.

Switch 10 has a left and right hand housing portions 12, 14, which may be constructed of any suitable insulating material known in the art, such as molded glass-filled thermoplastic or thermosetting plastic. Line side strap 16 conducts electric power from the power source (not shown) and load side strap 18 conducts electric power from the switch 10 to a load serviced by the switch (not shown). A load side pivot 20 is connected to load side strap 18, and it provides a pivot axis for respective left and right blades 22, 24. As shown, blades 22, 24 pivot from an "open" position, which means that the switch does not establish electrical power continuity from the line strap 16 to the load strap 18, to a "closed" position, wherein the blades 22,24 are in electrical contact with both the straps 16, 18 and thus establish electrical power continuity from the line to the load sides of the switch 10.

Sufficient bias contact pressure is provided between the straps 16, 18 and the respective portions of blades 22,24 when the switch is in the "closed", electric power conducting position. Sufficient bias pressure should be maintained throughout the useful service life of the switch, even as contact surfaces wear. The bias contact pressure between the straps 16, 18 and the blades 22,24 should be reduced when the switch is in the "open" position, so as to allow easier relative movement between the blades and straps.

Switch 10 has a pair of blade springs 26, 28, in contact with respective one of corresponding blades 22, 24. Each blade spring 26, 28 biases its corresponding blade 22, 24 inwardly, i.e., toward the straps 16, 18. The blade springs 26, 28 are coupled to the blades 22, 24 and a blade extension 30 by clevis pin 32 and corresponding washers 34 and cotter pin 36 or any device giving the same result. Each respective blade spring 26, 28 is preferably a leaf spring which has a central portion 26*a*, 28*a* which defines a bore 26*b*, 28*b* for passage of the clevis pin fastener 32 therethrough; and has a pair of legs projecting from the central portion thereof, wherein one of the legs 26*c*, 28*c* abuts the respective blade 22, 24 proximal the load strap 18 and the other of the legs 26*d*, 28*d* abuts the respective blade 22, 24 proximal the line strap 16. Leaf spring legs 26*c*, 28*c* each define a slot 26*e*, 28*e* for engagement with the pivot 20, so as to prevent rotation of the blade springs 26, 28 relative to the respective blades 22, 24.

The blade extension 30 is designed for coupling to a known switch bailing mechanism, which is not shown, and thus provides the motive force necessary to open and close the switch 10. The bailing mechanism is manipulated by an external actuation device, such as an operator handle.

The housing portions 12, 14 are secured together with cap screws 38 and nuts and washers 40, though it should be understood that other types of fasteners may be utilized, such as for example rivets, screws or by bonding the two housing portions together.

Switch 10 also has a plurality of arc plates 42, that assist extinguishment of electrical arc which may form between the blades 22, 24 and line strap 16 during transient current flow as the switch is being opened or closed.

If desired, switch 10 may be provided with wiring lugs, such as line side lug 44, which is retained to the line strap 16 by threaded fasteners 46. If the switch is intended to be used in a fused application, it may be fitted with a fuse holder 48 which is coupled to the load strap 18 by fasteners 50, spring loaded fuse holder or any device securing the fuse contact.

Switch 10 operates as follows: When the switch 10 is in the "open" position, the blades 22, 24 are positioned above and clockwise relative to the line strap 16. The blade springs 26, 28 are relatively less biased than when the switch 10 is in the "closed" position, because the blades 22, 24 are biased inwardly into free space with no resistance from the line strap 16. It thus follows that the relatively less biased blade springs 26, 28 exert less biasing pressure on the blades 22, 24 at their end which is pivotally coupled to the load strap 18 proximal the load side pivot 20. Thus physical effort necessary to pivot the blades 22, 24 is relatively low when they are not in contact with the line strap 16.

When the blade extension 30 is translated to actuate the switch from the "open" position to the "closed" position, the blades 22, 24 engage and override a beveled portion 52 of the line strap 16, and in doing so urges the blades outwardly against the blade spring 26, 28 biasing pressure resistance. The spring 26, 28 biasing pressure urges the blades 22, 24 into relatively higher contact pressure with the line side strap 16 as well as the load side strap 18. Thus, the blades 22,24 exert relatively lower contact pressure against the line and load straps 16, 18 when the switch 10 is in the "open" or "off" position than when it is in the "closed" or "on" position.

In accordance with the present invention, a portion of the electrical contact blade is selected as the contact surface. This contact surface is smaller in size and is raised relative to the surface of the blade. By decreasing the contact area to that of the raised surface, the force exerted by the blade springs 26,28 is concentrated in a smaller contact area thereby increasing the contact pressure.

However, a decreased contact area becomes too involved in the arc action of the switch which can quickly wear away the smaller contact surface in overload tests. This is because at high overload currents, the area of the blade which comes in contact with the stationary blade can become after operation too small to carry the current. In addition, when the bump is being eradicated by the arcing, the actual switch timing changes. The actual break point of the switch can change to such a degree that it is no longer a quick break from the contacts which in turn causes further degradation of the contacts. Thus, it is an object of the invention to preclude this degradation from occurring. One way in which this can be obtained is by limiting the decrease of the electric contact surface (or area) from wearing away due to arcing in overload tests. More particularly, it is an object of the present invention to prevent arcing to the electrical contact area and confine it to a designated sacrificial arcing surface of the switch contact blade away from the electrical contact surface area.

Damage due to arcing to the moveable switch contact blade occurs at the last contact location that the moveable switch contact blade makes with the stationary blade. Thus, as the switch cycles through normal operation, the outermost point of the moveable switch contact blade is where arcing is initiated. Arcing degrades the moveable switch contact blade by vaporizing a portion of the material at the point of contact. As the area becomes smaller, the current passing through it vaporizes the material. The moveable switch contact blade of prior art designs therefore progressively decreases in size from the outermost point of the blade in towards the electrical contact surface which was initially subject to arcing. This results in the movement of the electrical contact of the switch blade further in from the outermost edge of the blade. The moveable switch blade therefore decreases in size from its outermost edge, moving the area of electrical contact in from the outermost edge. This will ultimately result in the destruction and elimination of the electrical contact area of the moveable switch blade of prior art designs.

Figure 3:
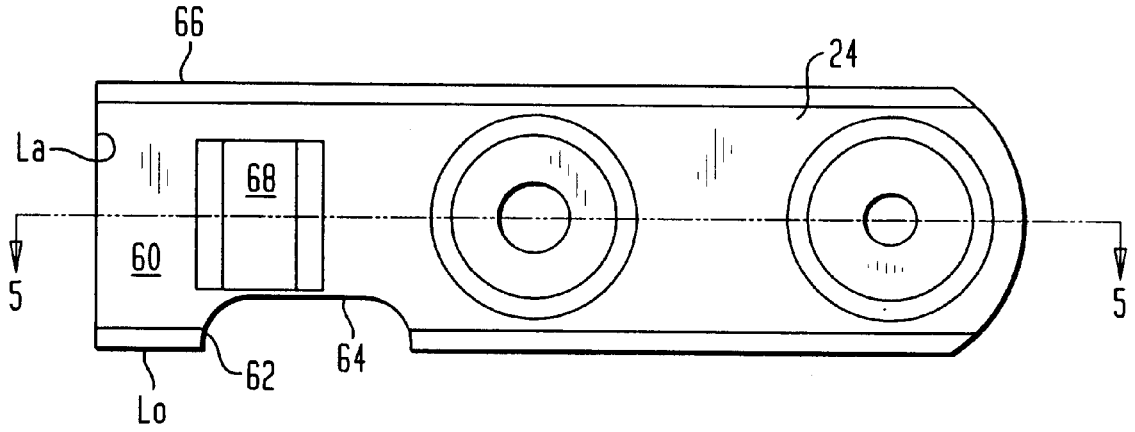
FIG. 3 is an enlarged side view of the blade shown in FIG. 2.
Figure 4:
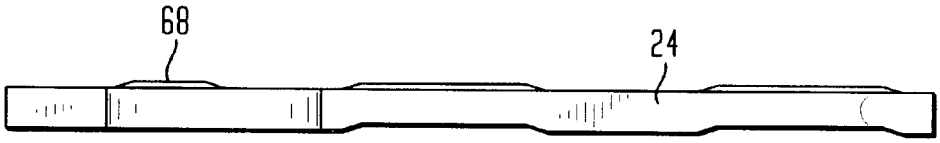
FIG. 4 is an enlarged top view of the blade shown in FIGS. 2–3.
Figure 5:
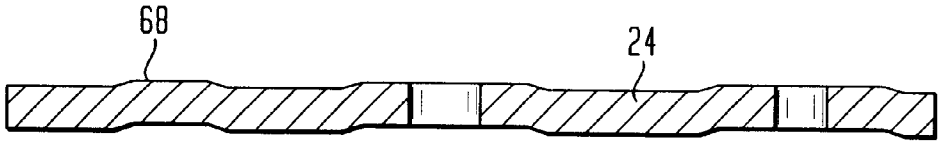
FIG. 5 is a sectional view taken along line 5—5 in FIG. 3 of the blade shown in FIGS. 2–4.

In accordance with the present invention, a physical barrier constituting a notch formed in the moveable contact blade of a switch is provided which forms a barrier within which arcing does not occur. Referring to FIG. 3, arcing is confined to the area from the proximate end 60 of moveable contact switch blade 24 to the beginning 62 of notch 64. As material of the blade is progressively destroyed by arcing, the longitudinal edge $L_0$ is progressively eliminated by the arc as it is confined to move from the point or beginning 62 of notch 64. When arcing again occurs, it will occur at the closest point of contact on moveable contact switch blade 24 with the stationary contact blade (i.e. line side strap 16 in FIG. 1) which occurs near point 62. Arcing then progressively moves from the longitudinal edge $L_0$ of the blade 24 into the blade in the direction of the far edge 66, and then longitudinally outward toward lateral edge $L_a$ which extends along proximate end 60. Thus, according to one aspect of the invention, the arc is thereby confined or forced to take a path progressing from point 62 away from raised electrical contact surface 68 to a designated sacrificial arcing surface and is thereby prevented from moving towards contact surface 68.

By requiring the arc to follow a preferential path away from raised electrical contact surface 68 and confined to a designated sacrificial arcing surface as described above, the contact surface 68 is not effected by arcing, thereby increasing the life of moveable electrical contact blade 24 and therefore the life of the switch 10.

Thus, in accordance with the present invention, the notch 64 in moveable contact switch blade 24 confines arc damage to a designated arcing surface which degrades in such a manner that it forms a better lead in the switch as it is operated. The arching removes lead in material on both the moveable and stationary contacts. The switch naturally wears in such a manner that the movable contacts mate more accurately. As a result, the contact surface shown in FIG. 3 not only performed well at the start of overload testing, but actually worked better as the switch was operated. The bump maintains the timing of the switch along with increasing pressure. The notch prevents the degradation of the bump thus increasing contact life. As arcing takes place, the moveable and stationary contacts naturally wear to match the shape of one of the other thereby reducing force required to engage the contacts.

While the present invention has been particularly shown and described with reference to preferred embodiments thereof, it is understood by those skilled in the art that various changes in form and details may be made therein without departing from the spirit and scope of the invention.

What is claimed:

1. An electric switch comprising:

(a) a housing;

(b) a line side strap;

(c) a load side strap;

(d) a switch blade for establishing electrical continuity by making electrical contact to the line side strap and to the load side strap and for breaking electrical contact to the line side strap and to the load side strap, the blade having a raised electrical contact surface positioned toward a proximate end; and (e) a blade spring for contact with and biasing the switch blade toward the line side strap and the load side strap; wherein the switch blade further has a longitudinal edge and a far edge, and wherein a notch is formed into the switch blade from the longitudinal edge toward the far edge, the notch being disposed toward the proximate end of the switch blade; and wherein the raised electrical contact surface of the switch blade is positioned between the proximate end and the notch, the notch being constructed and arranged with respect to the raised electrical contact surface such that when an arching condition occurs in the switch, an arc moves from a point defining a portion of the notch and away from the raised electrical contact surface.

2. The switch as in claim 1 wherein the notch is arcuate in shape and the point is disposed on the arcuate shape which intersects the longitudinal edge, and wherein the raised electrical contact surface has a portion disposed toward (i) the proximate end of the switch blade and (ii) the point.

3. The switch of claim 2 wherein the raised electrical contact surface is disposed generally adjacent to the notch and between the notch and the far edge.

* * * * *